US007686472B1

(12) United States Patent
Huang

(10) Patent No.: US 7,686,472 B1
(45) Date of Patent: Mar. 30, 2010

(54) SELF-DEFENSE FLASHLIGHT WITH PROTECTABLE SHARP EDGES

(75) Inventor: John Huang, South San Francisco, CA (US)

(73) Assignee: PentagonLight, South San Francisco, CA (US)

( * ) Notice: Subject to any disclaimer, the term of this patent is extended or adjusted under 35 U.S.C. 154(b) by 233 days.

(21) Appl. No.: 12/022,102

(22) Filed: Jan. 29, 2008

(51) Int. Cl.
*F21L 4/00* (2006.01)

(52) U.S. Cl. ..... 362/202; 362/109; 362/119; 362/253; 362/208

(58) Field of Classification Search ..... 362/200–208, 362/102, 109, 119, 120, 253
See application file for complete search history.

(56) References Cited

U.S. PATENT DOCUMENTS

| | | | | |
|---|---|---|---|---|
| 5,373,427 | A * | 12/1994 | McLean | 362/96 |
| 5,446,985 | A * | 9/1995 | Chen | 42/1.08 |
| 6,666,566 | B1 * | 12/2003 | Uke | 362/202 |
| 7,069,926 | B2 * | 7/2006 | Skellern et al. | 128/200.14 |
| 7,100,602 | B2 * | 9/2006 | Cole et al. | 128/200.14 |
| 7,509,955 | B2 * | 3/2009 | Cole et al. | 128/200.14 |
| 7,559,439 | B2 * | 7/2009 | Cellini et al. | 222/78 |
| 2004/0188471 | A1 * | 9/2004 | Cellini et al. | 222/192 |
| 2004/0228120 | A1 * | 11/2004 | Ross | 362/110 |
| 2006/0050502 | A1 * | 3/2006 | Ross et al. | 362/110 |
| 2006/0096590 | A1 * | 5/2006 | Cole et al. | 128/200.14 |
| 2008/0049418 | A1 * | 2/2008 | Ross et al. | 362/109 |

* cited by examiner

*Primary Examiner*—Bao Q Truong
(74) *Attorney, Agent, or Firm*—Brill Law Office; Jeffrey Brill

(57) ABSTRACT

A self-defense flashlight includes sharp edges positioned around the head end. A sharp edge protector can be positioned so as to surround and protect the sharp edges, when the flashlight is not being used for self-defense purposes. When needed, the sharp edge protector can be moved so as to expose the sharp edges, allowing the flashlight to be used as a weapon. The protectable sharp edges can also be positioned around the tail end of the self-defense flashlight.

10 Claims, 6 Drawing Sheets

SELF-DEFENSE FLASHLIGHT WITH PROTECTABLE SHARP EDGES

TECHNICAL FIELD

This invention pertains generally to flashlight technology, and more specifically to an improved self-defense flashlight with protectable spikes.

BACKGROUND ART

A flashlight is an essential tool for law enforcement officers. As part of an officer's duty gear, a flashlight provides an illumination source that can be critical during night shifts or when entering buildings and other potentially dark spaces. Law enforcement officers sometimes need to utilize physical force against perpetrators in the line of duty. Because one of the officer's hands can be utilized holding the flashlight, it is useful for the flashlight to have a secondary function as a weapon. Flashlights exist in which angled edges are positioned around the bezel of the head, for self-defense purposes. When needed, such a flashlight can serve as a weapon, for attacking an identified enemy. Positioning the angled edges around the heed of a flashlight naturally inflicts a wound on the enemy, as the force of the hand and arm movement is transferred to the edge when the flashlight is used to strike.

Some self-defense flashlights instead have angled edges positioned around the tail-end. Hand and arm force is transferred to spikes is this position when the flashlight is brought down to strike an enemy backwards, with the tail-end directed towards the target.

Whether the angled edges are positioned around the head or the tail, these edges of self-defense flashlights are dull, in order to prevent them from accidentally harming the carrier. If the angled edges where sharp, the law enforcement officer could easily be accidently cut or injured while carrying the flashlight. Having dull edges in a self-defense flashlight limits its usefulness, as a sharp surface would inflict greater injury on the enemy. Additionally, the exposed angled edges are subject to breaking or damage, rendering them even less useful. Furthermore, a potential enemy can see the angled edges, and thus the law enforcement officer looses the element of surprise that can be provided by a concealed weapon.

What is needed is a self-defense flashlight without the disadvantages of existing systems described above.

SUMMARY

In one embodiment, a self-defense flashlight includes sharp edges positioned around the head end. A sharp edge protector can be positioned so as to surround and protect the sharp edges, when the flashlight is not being used for self-defense purposes. When needed, the sharp edge protector can be moved so as to expose the sharp edges, allowing the flashlight to be used as a weapon. In another embodiment, the protectable sharp edges are positioned around the tail end of the self-defense flashlight.

The features and advantages described in this summary and in the following detailed description are not all-inclusive, and particularly, many additional features and advantages will be apparent to one of ordinary skill in the relevant art in view of the drawings, specification, and claims hereof. Moreover, it should be noted that the language used in the specification has been principally selected for readability and instructional purposes, and may not have been selected to delineate or circumscribe the inventive subject matter, resort to the claims being necessary to determine such inventive subject matter.

The Figures depict embodiments of the present invention for purposes of illustration only. One skilled in the art will readily recognize from the following discussion that alternative embodiments of the structures and methods illustrated herein may be employed without departing from the principles of the invention described herein

DETAILED DESCRIPTION

Figure 1:
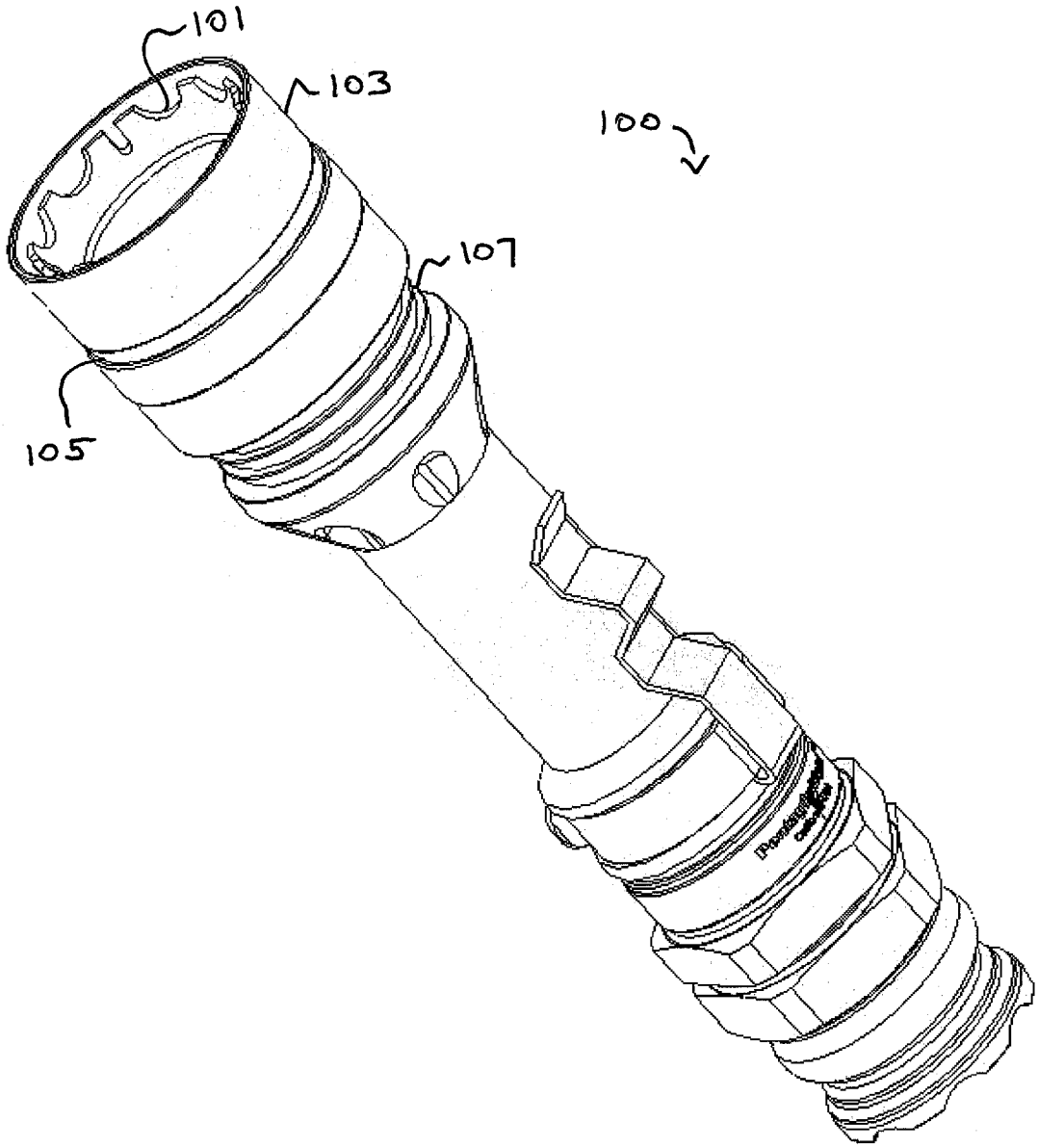
FIG. 1 illustrates a self-defense flashlight with spikes positioned around the head, with the spikes concealed by a movable spike protector, according to one embodiment of the present invention.

FIG. 1 illustrates a self-defense flashlight 100 in which sharp edges (spikes) 101 provide robust self defense, without risking accidental harm to the carrier or damage to the edges. As illustrated in FIG. 1, a movable protector 103 surrounds the spikes 101 when not needed for striking an enemy. In the embodiment illustrated in FIG. 1, the spike protector 103 is in the form of a cylinder wrapped around the head 105 to hide the spikes 101, thus preventing the protrusion of the sharp edges 101. The protector 103 thus prevents the spikes from inflicting accidental harm to the carrier when the flashlight 100 is not being used as a self-defense tool. The protector 103 not only protects the carrier, but also protects the spikes 101 themselves from potential damage. In addition, the protective ring 103 can act as a disguise to hide the sharp edges 101 from a potential enemy. This conceals the weapon from the potential attacker.

Figure 2:
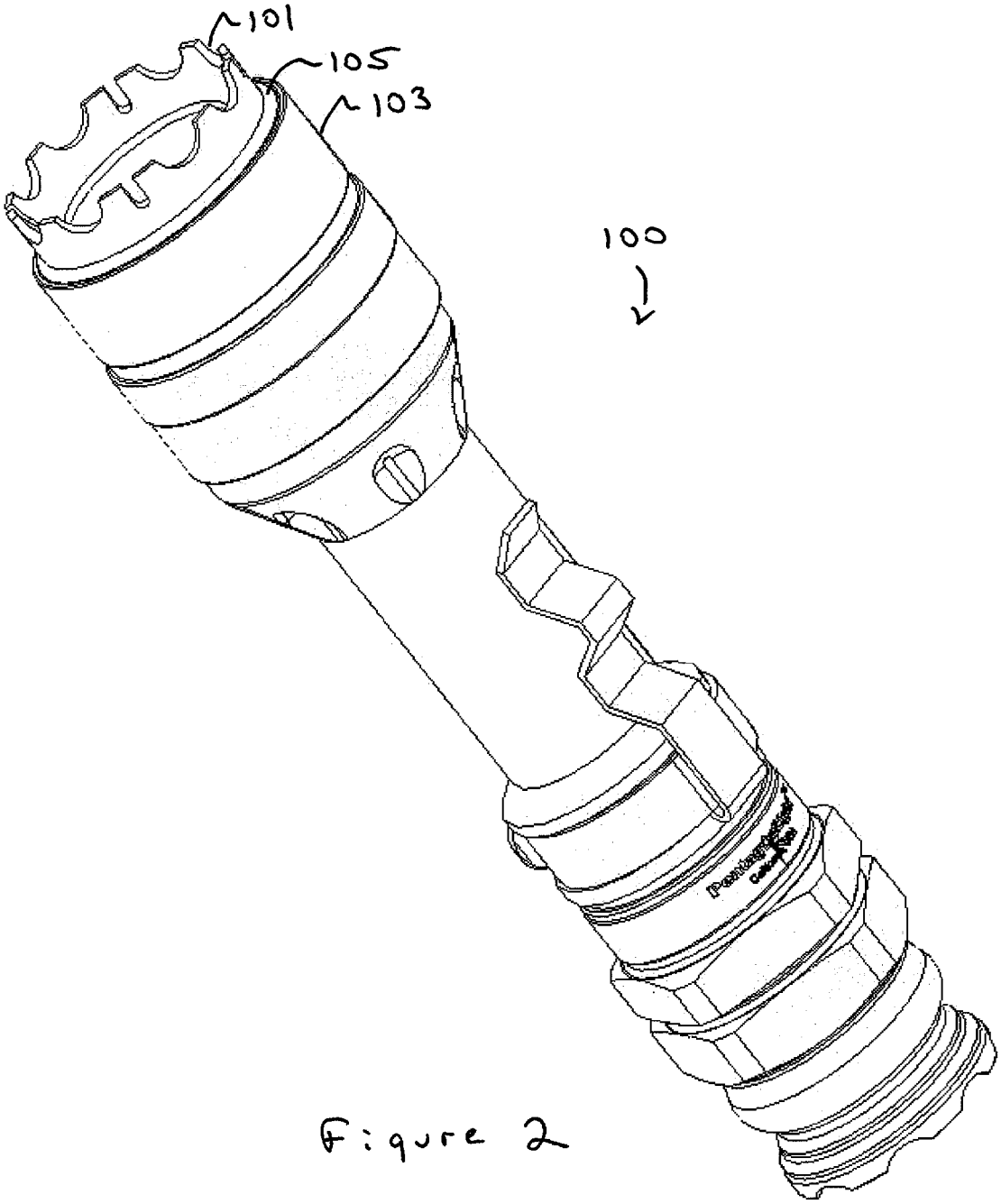
FIG. 2 illustrates a self-defense flashlight with a movable spike protector positioned so as to expose the spikes, according to one embodiment of the present invention.

As illustrated in FIG. 2, to utilize the flashlight 100 as a self-defense tool, the spike protector 103 is lowered to reveal the sharp edges 101. With the spike protector 103 lowered, the spikes 101 around the head 105 of the flashlight 100 protrude forward, and the sharp edges 101 are revealed for striking on the enemy. Positioning the spikes 101 around the head 105 is logical, since flashlights 100 are held in the hand for projecting light in order to identify potential threats. By positioning the spikes 101 around the head 105 with the sharp edge aligned along the longitudinal axis of the flashlight 101 following the projection of light, the target is illuminated as the spiked flashlight 100 is brought down to strike the enemy.

Returning now to FIG. 1, it is useful to be able to lower and raise the spike protector 103 quickly, to reveal or hide the spikes 101 underneath. Thus, in one embodiment, instead of utilizing conventional single threading, multiple staggered threads 107 are used to allow faster movement of the spike protector 103 from the top to the bottom in revealing the spikes 101. With such multiple staggered threads 107, by twisting the spike protector 103 between the thumb and the index finger, the spikes 101 can be quickly revealed as the self defense flashlight 100 is brought to an attack position in one single motion. It is to be understood that in other embodiments, conventional single threading (not illustrated) can be employed.

In both single and multiple threaded embodiments, the movement of the spike protector 103 is achieved by its rotation. The thread 107 between the head 105 and the spike protector 103 provides movement of the spike protector 103 along the longitudinal axis of the flashlight 100.

Figure 3:
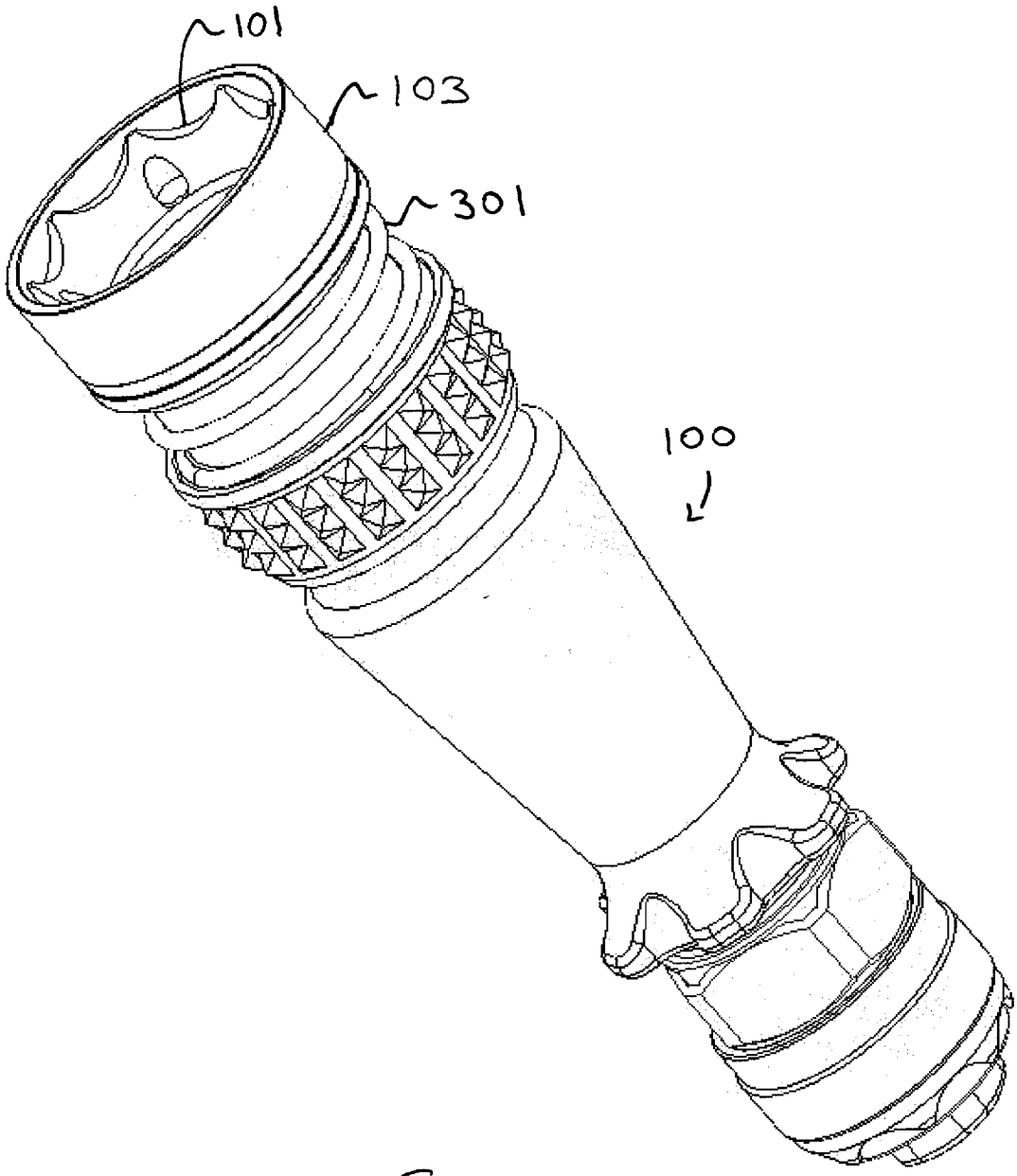
FIG. 3 illustrates a self-defense flashlight with spikes concealed by a spring loaded protector, according to one embodiment of the present invention.

Turning now to FIG. 3, note that even with multiple staggered threads 107, the exposure of the spikes 101 still takes time and effort, which can be detrimental in time critical combat situations. Therefore, in the embodiment illustrated in FIG. 3, the movement of the spike protector 103 is facilitated longitudinally and forced upward with a spring 301. The uncoiled spring 301 forces the spring-loaded spike protector 103 toward the front of the flashlight 100 to hide the sharp edges 101 as illustrated in FIG. 3. The extension force of the spring 301 conceals the spikes 101, and protects them 101 from damage and from inflicting accidental harm.

Figure 4:
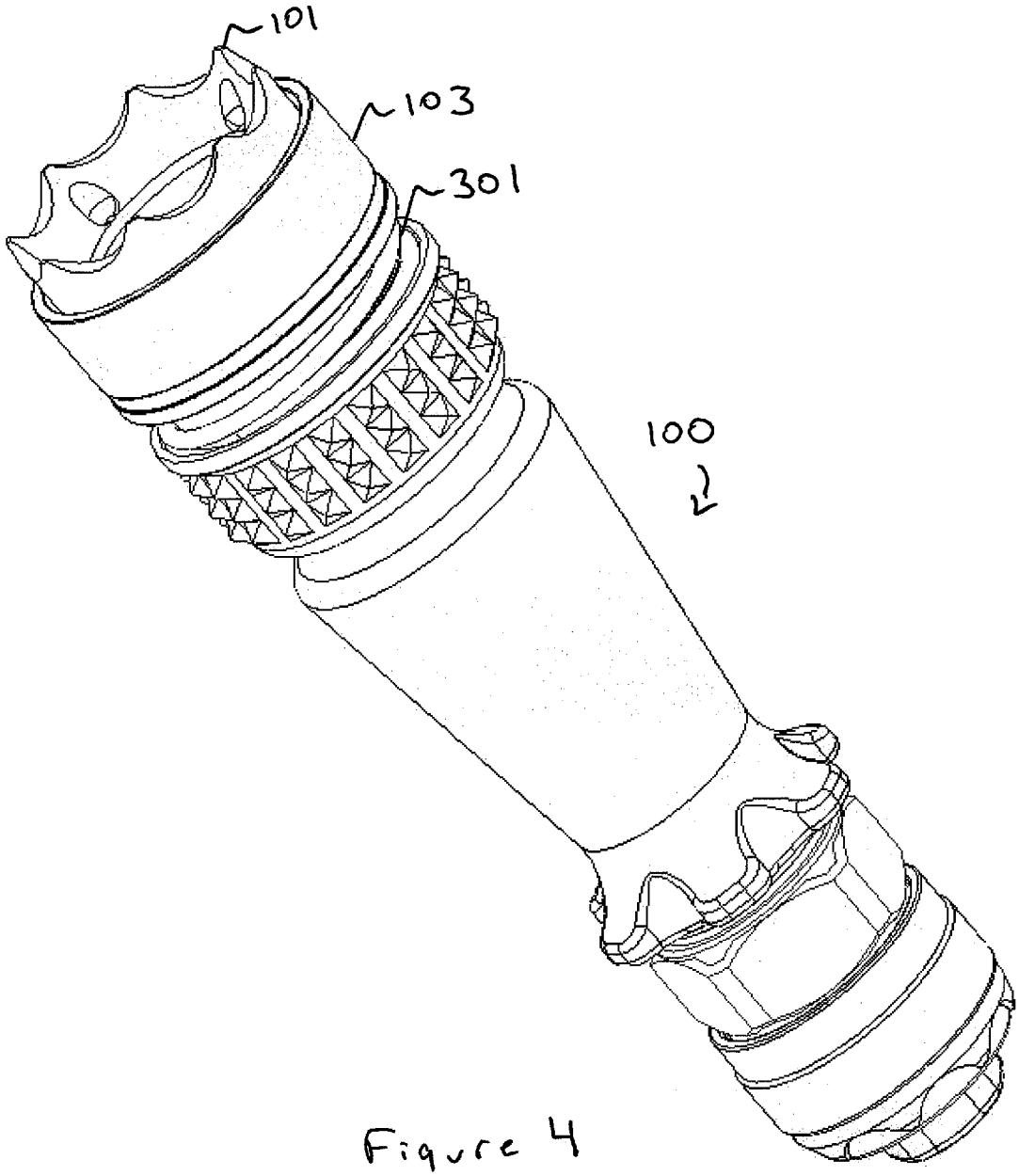
FIG. 4 illustrates a spring loaded protector positioned so as to expose the spikes of a self-defense flashlight, according to one embodiment of the present invention.

As illustrated in FIG. 4, the compression of the spring 301 moves the spike protector 103 backward as the flashlight 100 is brought down to strike an enemy. Since the spikes 101 are part of the body of the flashlight 100 in this embodiment, the spikes 101 penetrate into the flesh as the spike protector 103 moves backward with the compression of the spring 301.

Figure 5:
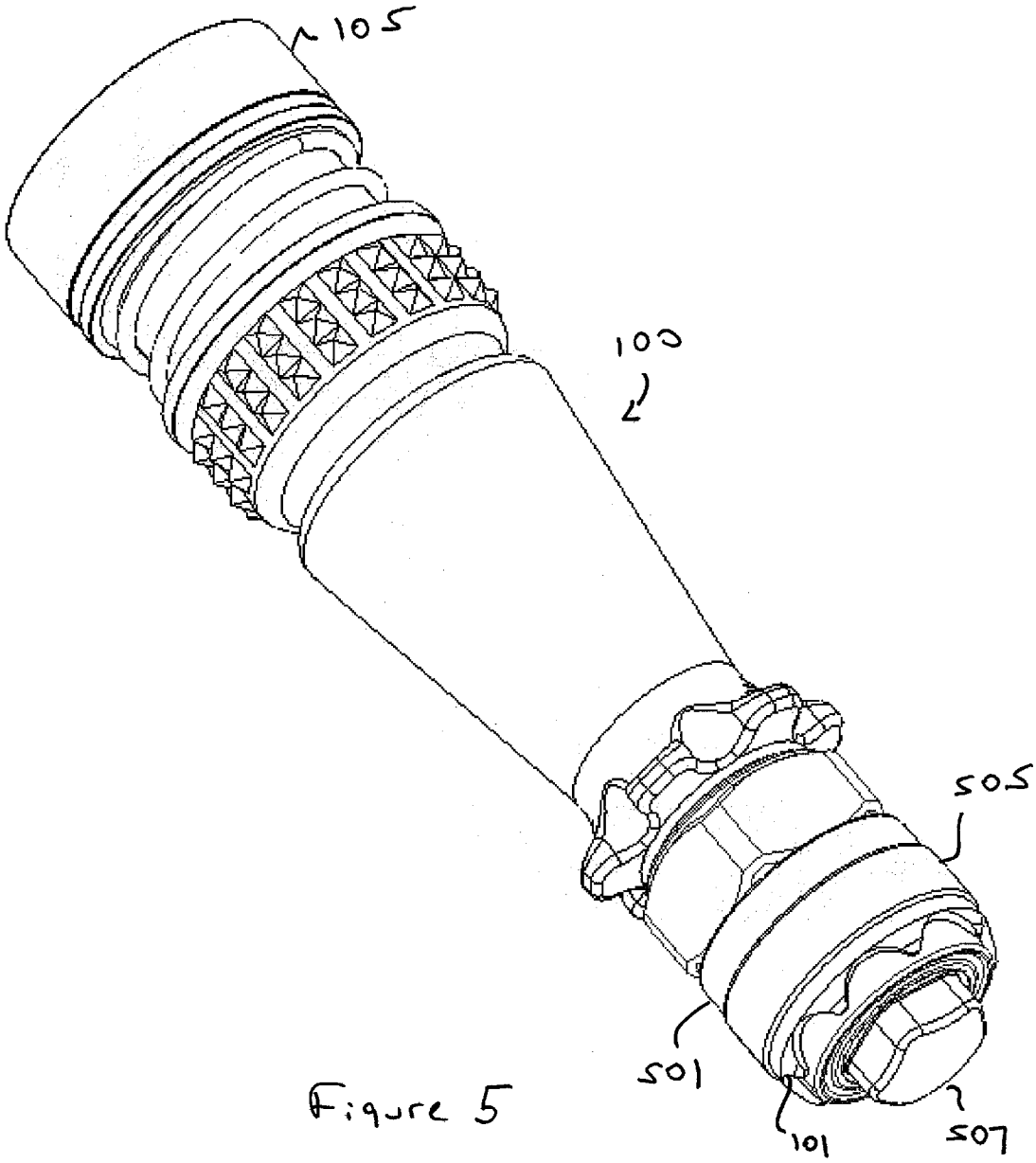
FIG. 5 illustrates a self-defense flashlight with concealed spikes in the tail-end, according to one embodiment of the present invention.
Figure 6:
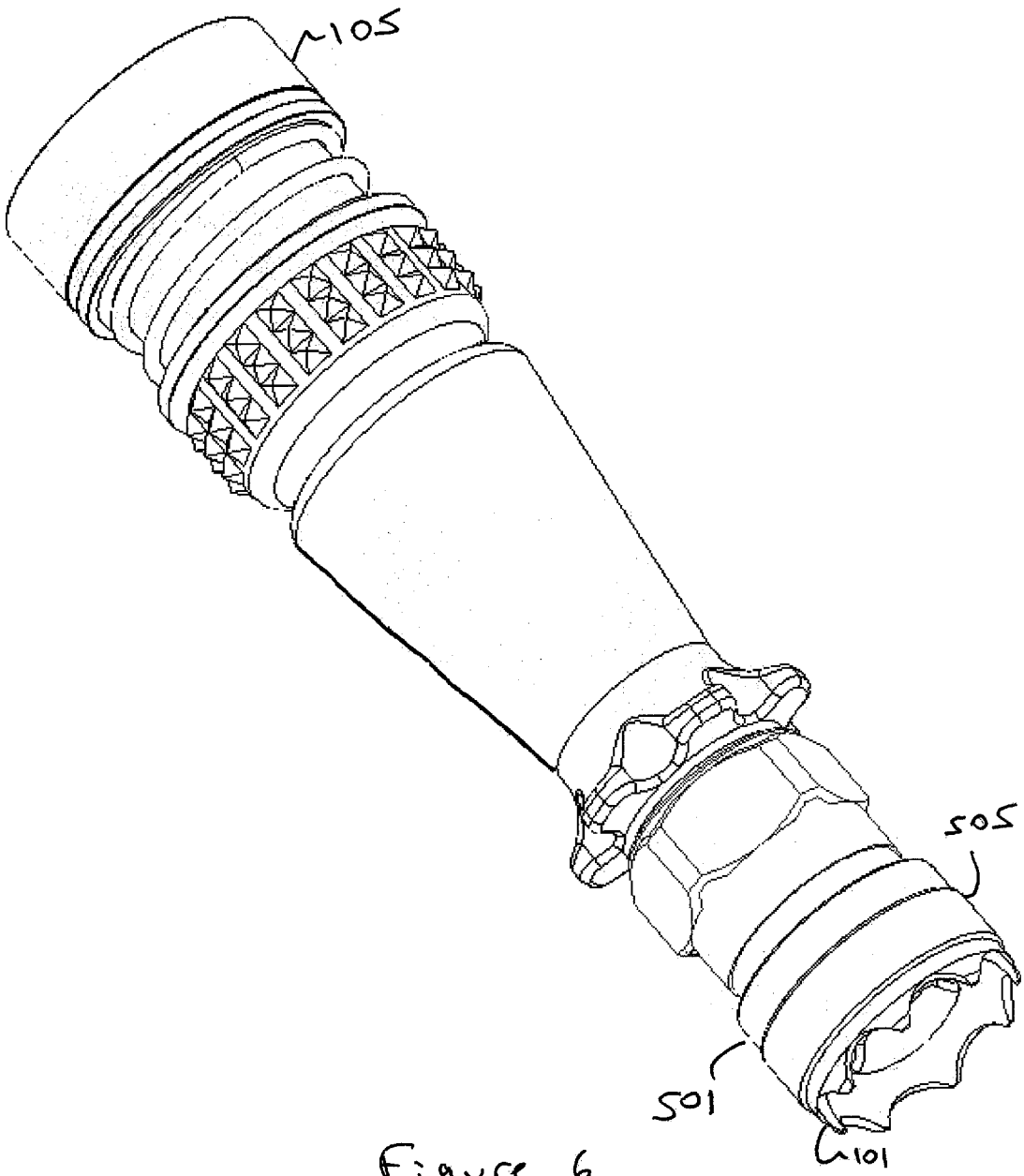
FIG. 6 illustrates a self-defense flashlight with spikes positioned in the tail-end exposed, according to one embodiment of the present invention.

FIG. 5 illustrates a different embodiment in which the spikes 101 are positioned around the tail-end 501 of a flashlight 100. As with the embodiments illustrated and described above, the spikes 101 are concealed and protected. As illustrated in FIG. 5, in this embodiment the spikes 101 are positioned at the back end of the tail-cap 501. However, instead of moving up and down a spike protector 103, a spike ring 505 is moved up and down. As illustrated in FIG. 5, the spikes 101 are protected when the spike ring 505 is lowered. As illustrated in FIG. 6, if the tail-end 501 needs to be used for self defense, the spike ring 505 can be quickly raised to reveal its sharp edges 101. In such an embodiment, the placement of the spikes 101 and the protector is reversed, with the spikes 101 on the outside in the form of a movable ring 505. As illustrated in FIG. 5, this design provides a larger area in the back of the tail-cap 501 for positioning a tail rubber switch 507 for activating the flashlight 100 if needed.

As will be understood by those familiar with the art, the invention may be embodied in other specific forms without departing from the spirit or essential characteristics thereof. Likewise, the particular naming and division of the members, features, attributes and other aspects are not mandatory or significant, and the mechanisms that implement the invention or its features may have different names, divisions and/or formats. Accordingly, the disclosure of the present invention is intended to be illustrative, but not limiting, of the scope of the invention, which is set forth in the following claims.

What is claimed is:

1. A flashlight with protectable sharp edges, the flashlight comprising the following components:

a substantially cylindrically shaped body comprising a head end and a tail end;

sharp edges positioned around the head end of the substantially cylindrically shaped body;

wherein said sharp edges are aligned along the longitudinal axis of the substantially cylindrically shaped body of said flashlight;

a substantially cylindrically shaped movable sharp edge protector;

wherein said sharp edge protector is movable between a first position and a second position along the longitudinal axis of the substantially cylindrically shaped body of said flashlight;

wherein in said first position said sharp edge protector protrudes forward from the head end of the substantially cylindrically shaped body past said sharp edges, such that said sharp edges are entirely surrounded by and positioned within said sharp edge protector; and wherein in said second position said sharp edge protector is positioned behind said sharp edges relative to the head end of said substantially cylindrically shaped body, such that said sharp edges protrude forward from the head end of the substantially cylindrically shaped body past said sharp edge protector.

2. The flashlight of claim 1 further comprising:

a threading along a portion of the substantially cylindrically shaped body;

wherein said sharp edge protector is movable between said first position and said second position by rotation along said threading.

3. The flashlight of claim 2 wherein:

said threading comprises multiple staggered threads.

4. The flashlight of claim 2 wherein:

said threading comprises a conventional single thread.

5. The flashlight of claim 1 further comprising:

a spring positioned around a portion of the substantially cylindrically shaped body;

wherein said sharp edge protector is movable between said first position and said second position by compression of said spring;

wherein said sharp edge protector is in said first position when said spring is uncompressed; and wherein said sharp edge protector is in said second position when said spring is compressed.

6. The flashlight of claim 1 wherein:

said sharp edges comprises a plurality of spikes.

7. A flashlight with protectable sharp edges, the flashlight comprising the following components:

a substantially cylindrically shaped body comprising a head end and a tail end;

sharp edges positioned around the tail end of the substantially cylindrically shaped body;

wherein said sharp edges are aligned along the longitudinal axis of the substantially cylindrically shaped body of said flashlight;

wherein said sharp edges are movable between a first position and a second position along the longitudinal axis of the substantially cylindrically shaped body of said flashlight;

wherein in said first position said sharp edges protrude backwards from the tail end of the substantially cylindrically shaped body; and wherein in said second position said sharp edges are positioned above said tail end of said substantially cylindrically shaped body, such that said tail end protrudes backwards from said sharp edges.

8. The flashlight of claim 1 further comprising:

a movable ring positioned around a portion of said substantially cylindrically shaped body;

wherein said sharp edges are positioned around said movable ring.

9. The flashlight of claim 1 further comprising:

a switch positioned at the tail end of said substantially cylindrically shaped body, said switch being configured for activating said flashlight.

10. The flashlight of claim 7 wherein:

said sharp edges comprises a plurality of spikes.

* * * * *